US005625950A

United States Patent [19]

Sterk et al.

[11] Patent Number: 5,625,950

[45] Date of Patent: May 6, 1997

[54] SHAVING APPARATUS

[75] Inventors: Olivier Sterk; Jan De Boer; Martinus M. Rijken, all of Drachten, Netherlands

[73] Assignee: U.S. Philips Corporation, New York, N.Y.

[21] Appl. No.: 455,618

[22] Filed: May 31, 1995

[30] Foreign Application Priority Data

Jul. 19, 1994 [EP] European Pat. Off. ..... 94202113

[51] Int. Cl.[6] ..... B26B 19/06; B26B 19/14

[52] U.S. Cl. ..... 30/43.6; 30/346.51

[58] Field of Search ..... 30/43.1, 43.6, 30/43.5, 89, 346.51

[56] References Cited

U.S. PATENT DOCUMENTS 4,168,570 9/1979 Bakker et al. ..... 30/43.6

4,318,223 3/1982 Bergsma et al. ..... 30/43.6

FOREIGN PATENT DOCUMENTS 811207 4/1959 France .

*Primary Examiner*—Douglas D. Watts

*Attorney, Agent, or Firm*—Ernestine C. Bartlett

[57] ABSTRACT

A shaving apparatus is provided having a housing (1), provided with a holder (2) in which at least one cutting unit (3) is mounted, which cutting unit comprises an external cutting member (4) and an internal cutting member (5) which is rotatably drivable relative to said external cutting member, and provided with a skin supporting rim (6) surrounding the external cutting member, which external cutting member (4) has at least one hair-entry aperture (8) and is mounted so as to be movable relative to the holder (2), said internal cutting member (5) being in resilient engagement with the external cutting member. For a better control of the pressure between the external cutting member (4) and the skin the skin supporting rim (6) is pivotable both relative to its associated external cutting member (4) and relative to the holder (2).

7 Claims, 8 Drawing Sheets

SHAVING APPARATUS

FIELD OF THE INVENTION

The invention relates to a shaving apparatus having a housing, provided with a holder in which at least one cutting unit is mounted, which cutting unit comprises an external cutting member and an internal cutting member which is rotatably drivable relative to said external cutting member, and provided with a skin supporting rim surrounding the external cutting member, which external cutting member has at least one hair-entry aperture and is mounted so as to be movable relative to the holder, said internal cutting member being in resilient engagement with the external cutting member.

BACKGROUND OF THE INVENTION

Such a shaving apparatus is known from U.S. Pat. No. 4,168,570. In the known apparatus the skin supporting rim is formed by the edge of the opening of the holder in which the cutting units are mounted. The skin supporting rim serves for slightly tautening the skin before the external cutting member is moved over the skin. Thus, it is achieved that the hairs to be severed are better erected so that they can be severed better and closer to the skin. An even more important function of the skin supporting rim is to support the skin around the external cutting member. This ensures that the pressure on the external cutting member does not become too high. An excessive pressure leads to skin injury and irritation because the skin then penetrates further into the hair-entry apertures and can come into contact with the internal cutting member. The external cutting member is mounted in the holder so as to allow movement in, preferably, any direction. As a result, the shaving surface, which is formed by the outer surface of the external cutting member facing the skin, can readily adapt itself to the shape of the facial area to be shaved. The maximum permissible tilting angle of the external cutting member, is determined by the length over which the external cutting member projects above the skin supporting rim. A large projection length gives rise to large pressure peaks on the peripheral parts of the external cutting member because the skin supporting rim cannot properly support the skin. As already stated above, a higher pressure leads to skin injury and irritation. When the external cutting member is tilted relative to its associated skin supporting rim, this rim cannot perform its skin supporting function in an optimum manner because this skin supporting rim is situated further from the shaving surface of the external cutting member. Moreover, large undesirable pressure peaks are produced on that part of the external cutting member which has the largest projection length.

SUMMARY OF THE INVENTION

It is the object of the invention to provide a shaving apparatus in which the pressure on the external cutting member is controlled more effectively.

To this end the invention is characterized in that the skin supporting rim is pivotable both relative to its associated external cutting member and relative to the holder. This precludes pressure peaks on the external cutting member. The external cutting member can tilt through a larger angle than in the prior-art shaving apparatus. As a result, the shaving apparatus is more conformable to the shape of the face. Since the external cutting member is arranged to be movable in any direction and is consequently also depressible, whereas the associated skin supporting rim is only pivotable and not depressible, a limitation of the maximum pressure is obtained. Thus, the skin supporting rim also has a protective function.

A first variant is characterized in that the skin supporting rim is pivotable about two axes which are perpendicular to one another.

A second variant is characterized in that it comprises two circular cutting units whose skin supporting rims are pivotable about a common axis which extends parallel to a connecting line through the centers of the cutting units.

A third variant is characterized in that it comprises two or more circular cutting units each having a skin supporting rim which is pivotable about an axis situated in a plane parallel to a shaving plane defined by outer surfaces of the external cutting members, which axis extends perpendicularly to a connecting line between the center of each cutting unit and the center of gravity of the combination of cutting units.

A modification thereof is characterized in that the skin supporting rims are coupled to one another by means of a hinge construction. The hinge construction should have some freedom of movement in the direction of the centers of the cutting members. Preferably, the hinge construction is a so-called tongue-and-groove construction or an elastic hinge.

BRIEF DESCRIPTION OF THE DRAWINGS

The invention will now be described in more detail with reference to an exemplary embodiment shown in the drawings. In the drawings.

DETAILED DESCRIPTION OF THE PREFERRED EMBODIMENTS

Figure 1:
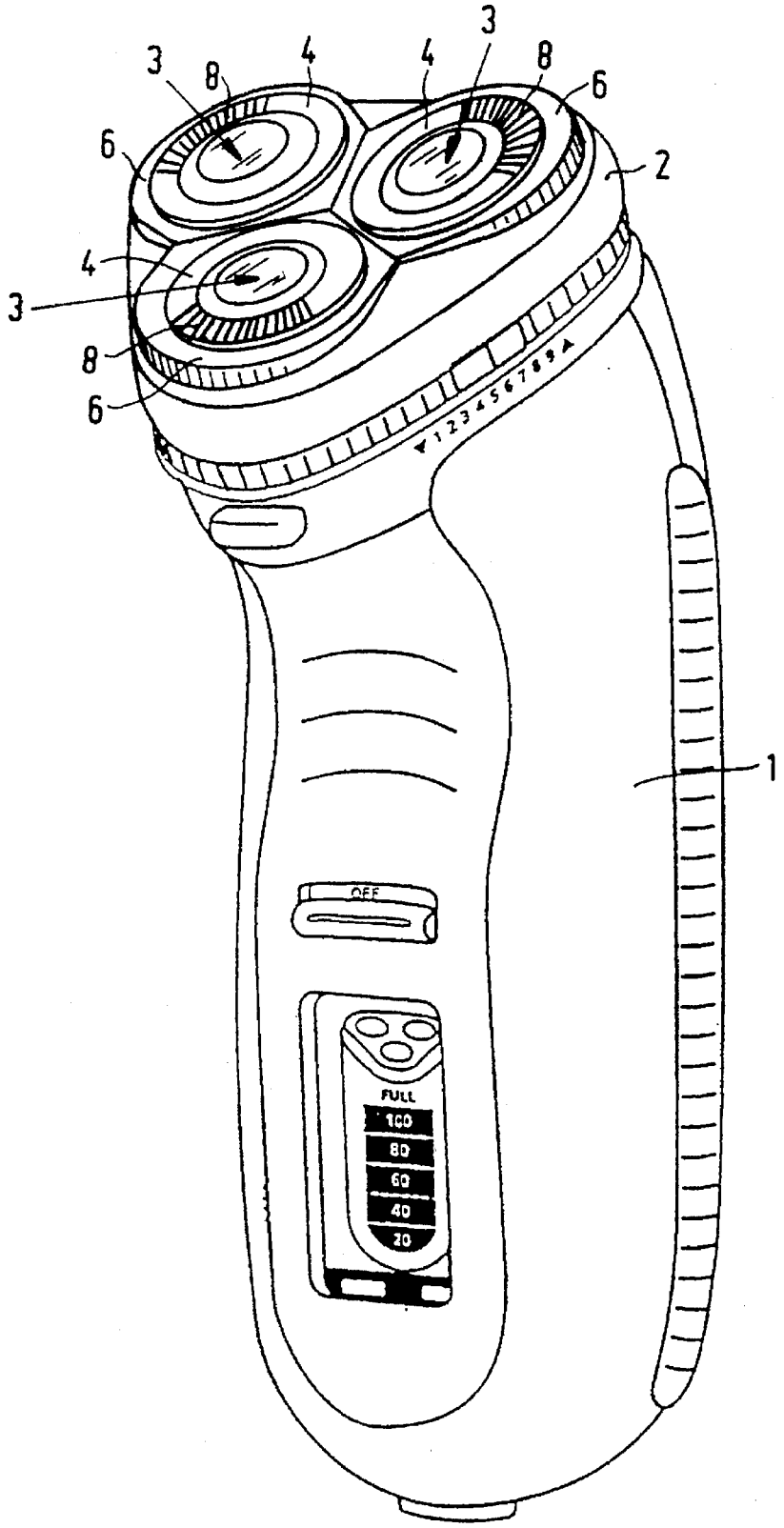
FIG. 1 is a perspective view showing a shaving apparatus with three cutting units, in which the invention is used.
Figure 2A:
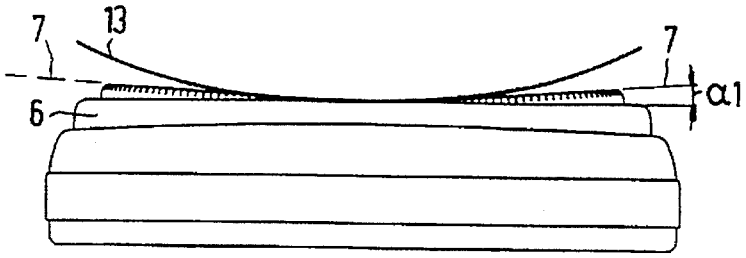
FIGS. 2*a*–2*b* show a cutting unit with a skin supporting rim which, in accordance with the prior art, is immobile relative to the holder.
Figure 2B:
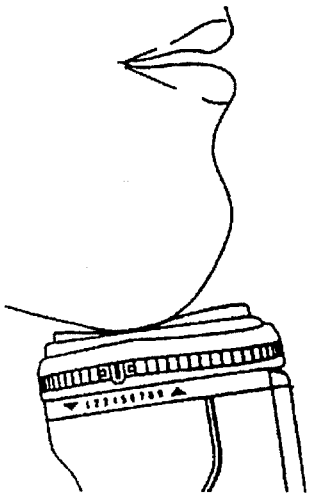
Figure 4A:
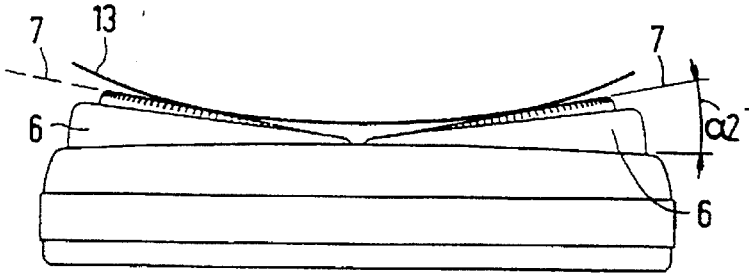
FIGS. 4*a*–4*b* show a cutting unit with a skin supporting rim which, in accordance with the invention, is pivotable relative to the holder.
Figure 4B:
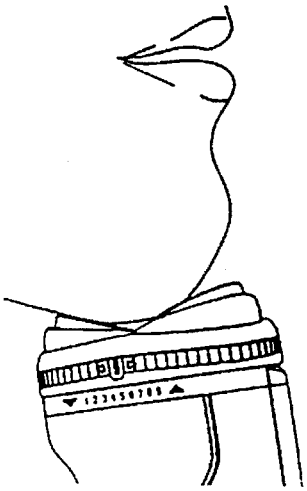

The rotary shaving apparatus shown in FIG. 1 has a housing 1 with a detachable holder 2. In the holder three cutting units 3 are mounted, which units each comprise an external cutting member 4 and an internal cutting member 5 (see FIG. 7*a*), the external cutting member being surrounded by a skin supporting rim 6. The external cutting member 4, which is generally circular, has a substantially flat shaving surface 7 and has a multitude of slit-shaped hair entry apertures 8. The internal cutting member 5 has a number of cutters 9 (see FIG. 7*a*) secured to a support 10. The support can be coupled to a coupling pin 11, which is rotatable by a motor, not shown. The coupling pin 11 is provided with a spring 12, which urges the internal curing member 5 towards the external cutting member 4 so as to maintain proper contact between the cutting members during shaving. In addition, the external cutting member 4 can be supported relative to the holder 2 by resilient means, as described in said U.S. Pat. No. 4,168,570. This makes the external cutting member 4 resilient in a direction perpendicular to the shaving surface 7 in such a manner that the external cutting member can also be tilted slightly relative to the holder. Thus, the external curing member is movable in any direction relative to the holder. In the prior-art shavers of the type described above the skin supporting rim 6 is a rim which is fixedly connected to the holder 2. In FIGS. 2*a*–2*b*, which illustrate the prior-art situation, the skin supporting rims 6 and the holder 2 form an integral part. In FIGS. 4*a*–4*b*, which illustrate the situation in accordance with the invention, each skin supporting rim 6 takes the form of a separate part, which is pivotable relative to both its associated external cutting member 4 and the holder 2.

Figure 3:
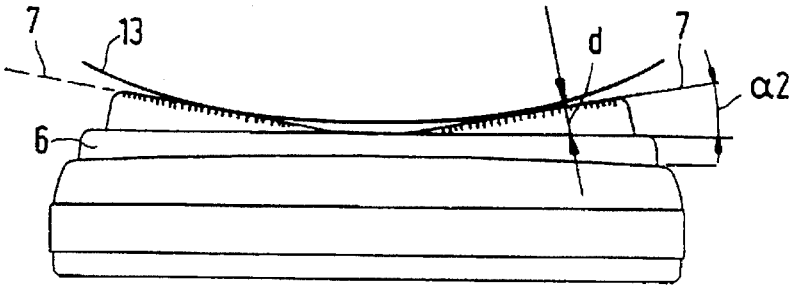
FIG. 3 shows a cutting unit with a skin supporting rim as shown in FIG. 2*a* but with a larger tilting angle of the external cutting member.
Figure 5:
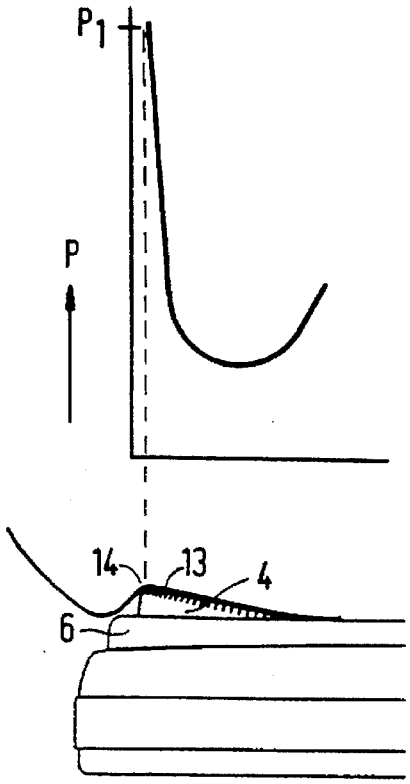
FIG. 5 shows a cutting unit with an immobile skin supporting rim and the pressure distribution near peripheral parts of the cutting member during contact with the skin in accordance with the prior art.

The external cutting member 4 is arranged to be movable in any direction relative to the holder 2, so that the shaving surface 7 can readily adapt itself to the shape of the facial area to be shaved. This is the prior-art situation shown in FIGS. 2*a*–2*b*. The line 13 represents a curved portion of a facial area to be shaved. As a result of the curvature of the face the external cutting members 4 will be tilted through an angle $\alpha 1$, so that the shaving surface is in better contact with the curved portions of the face. As is shown in FIG. 2*a*, the facial areas which are situated nearer the ends of the curved line 13 are not in contact with the shaving surface 7. A possibility of achieving this contact would be by allowing a larger tilting angle of the external cutting member 4 (tilting angle $\alpha 2$). This is illustrated in FIG. 3. It is clearly shown that the curved line 13 is now better in contact with the shaving surface. However, the distance d between the outer portions of the curved line and the skin supporting rim 6 has increased to such an extent that the skin is no longer supported by the skin supporting rim. See also FIG. 5. At the peripheral parts 14 of the cutting member 4 this leads to large pressure peaks (P1) on the skin and a risk of skin injury and irritation.

Figure 6:
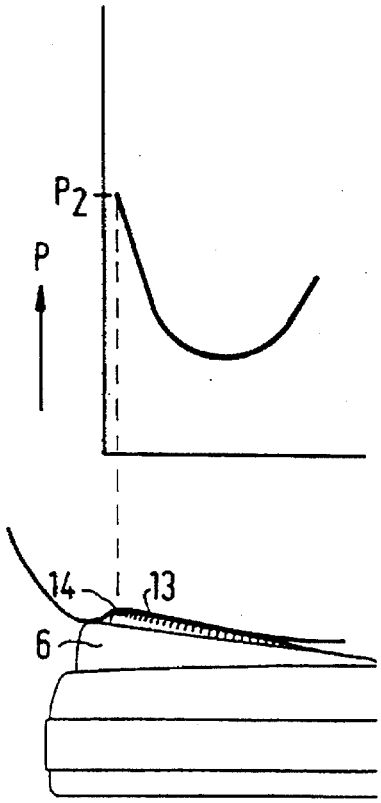
FIG. 6 shows a cutting unit with a pivotable skin supporting rim and the pressure distribution near peripheral parts of the cutting member during contact with the skin in accordance with the invention, FIGS. 7*a, b, c, d* show a cutting unit with a skin supporting rim which is pivotable in any direction relative to the holder, FIGS. 8*a, b, c, d* show a cutting unit with a skin supporting rim which is pivotable relative to the holder about two mutually perpendicular axes, FIGS. 9*a, b, c* show a cutting unit with a skin supporting rim which is pivotable relative to the holder about one axis.

FIGS. 4*a*–4*b* illustrate the situation in accordance with the invention. When the external cutting member 4 is tilted the associated skin supporting rims 6 are also tilted. This does not only result in a large tilting angle $\alpha 2$ of the cutting member but it also ensures that an effective support of the skin by the skin supporting rim is maintained. The pressure (P2) on the peripheral parts of the cutting member is substantially lower. See also FIG. 6. This provides a better control of the pressure on the external cutting member.

Figure 7A:
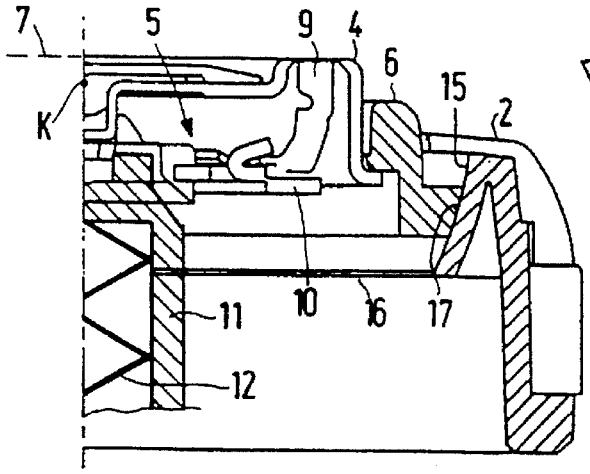
Figure 7B:
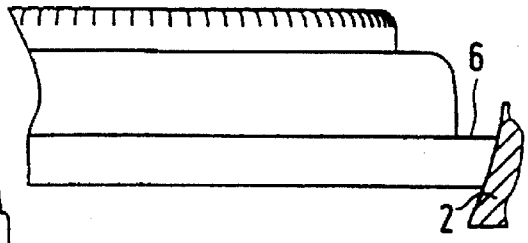
Figure 7C:
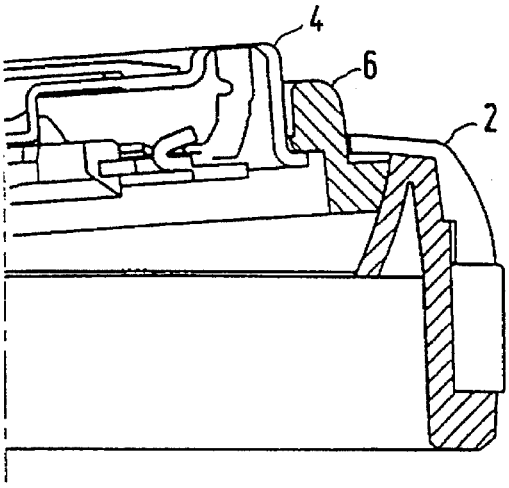
Figure 7D:
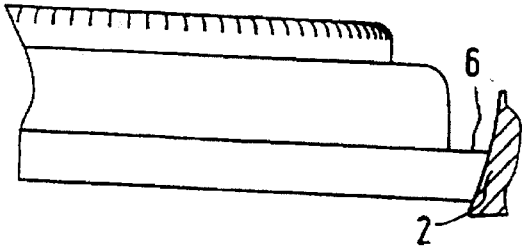

FIGS. 7*a*–7*d* show a cutting unit in which the skin supporting rim 6 with the cutting members is pivotable in any direction in the holder 2. For this purpose the inner edge 15 of the opening 16 in the holder 2 holding the cutting unit has a concave shape and an outer edge 17 of the skin supporting rim 6 has a corresponding convex shape. The tilting point bears the reference K. FIGS. 7*a*–7*b* show the cutting unit in a non-tilted center position. FIG. 7*c* shows the cutting unit (with the skin supporting rim) tilted in one direction and in FIG. 7*d* tilted in a direction perpendicular thereto.

Figure 8A:
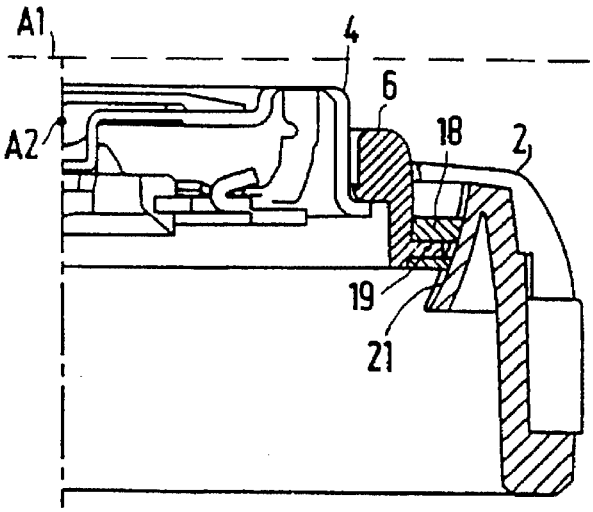
Figure 8B:
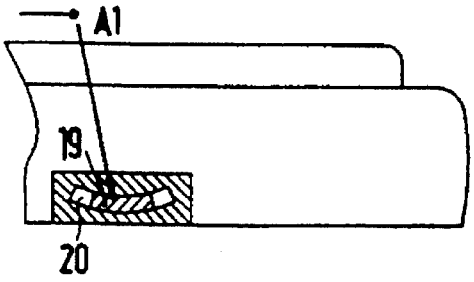
Figure 8C:
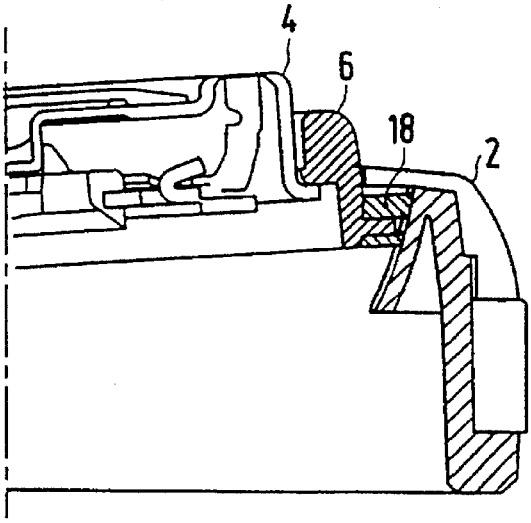
Figure 8D:
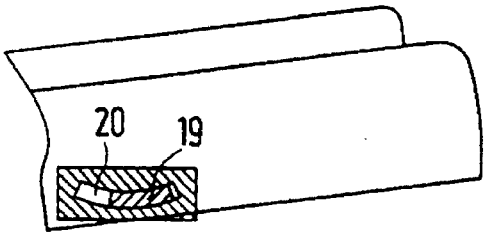

FIGS. 8*a*–8*d* show a cutting unit in which the skin supporting rim with the cutting members is pivotable about two axes perpendicular to one another. For this purpose the skin supporting rim 6 has bearing projections 18. For each projection the skin supporting rim has an arcuate pin 19 which engages an arcuate opening 20 in the projection. Thus, the cutting unit can be tilted about an axis A1. FIG. 8*d* shows this tilt relative to FIG. 8*b*. The tilt about an axis A2, which is perpendicular to the axis A1, is obtained in that the projection 18 is slidable in a cylindrical recess 21 in the inner edge 15 of the holder 2. FIG. 8*c* shows this tilt relative to FIG. 8*a*.

Figure 9A:
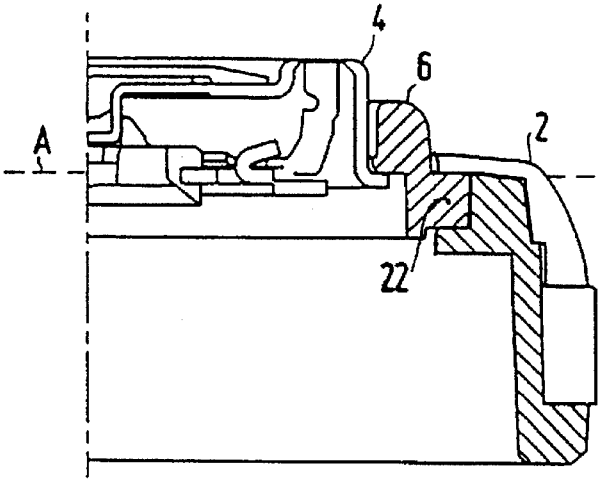
Figure 9B:
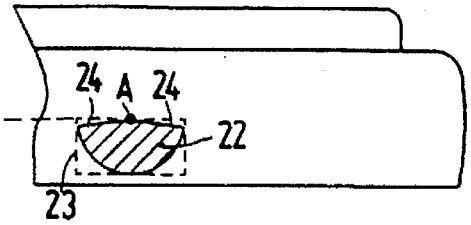
Figure 9C:
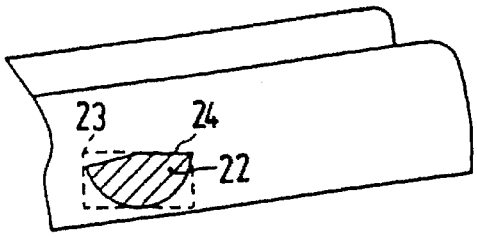
Figure 15:
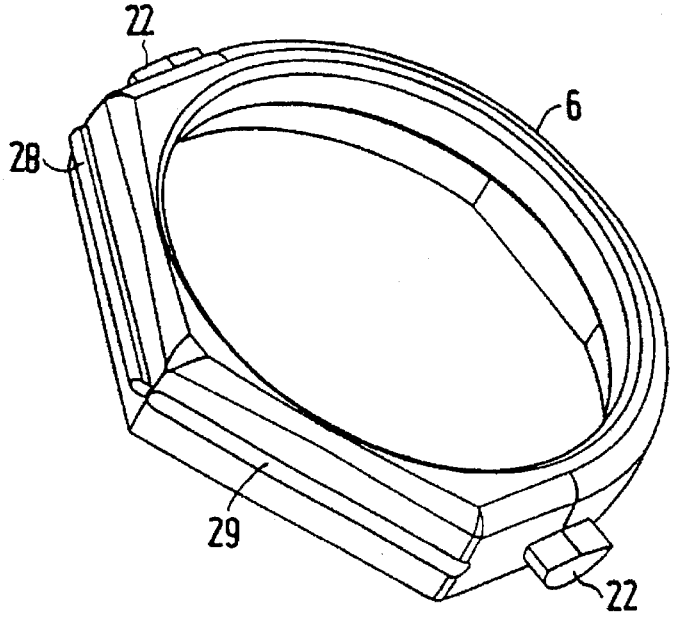
FIG. 15 is a perspective view of a skin supporting rim as shown in FIG. 14.
Figure 16:
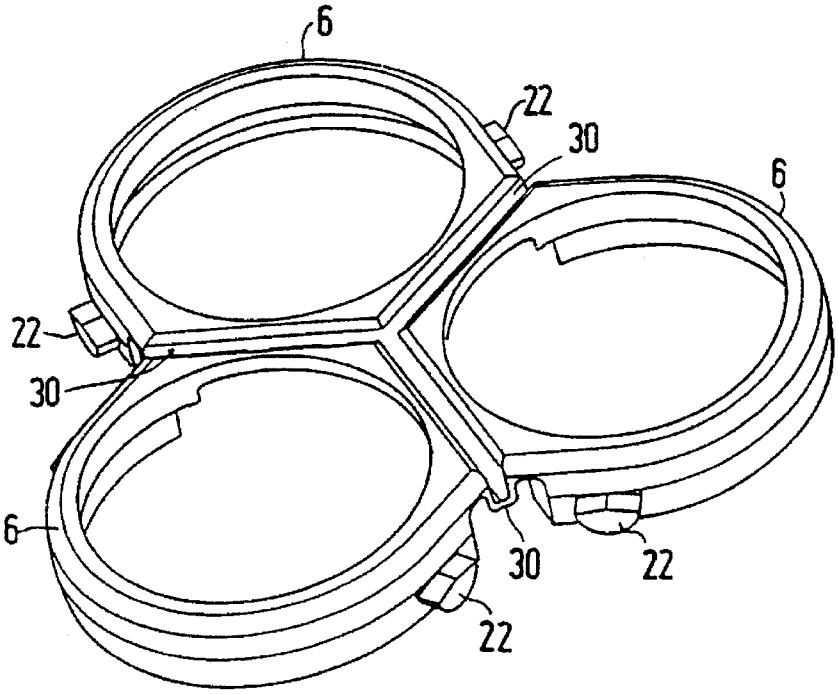
FIG. 16 is a perspective view showing an element comprising three skin supporting rims for a triple-head shaving apparatus, the skin supporting rims being coupled to one another by an elastic integral hinge.

FIGS. 9*a*–9*c* show a cutting unit in which the skin supporting rim 6 is pivotable about one axis A. For this purpose the skin supporting rim has two diametrally opposed projections 22, which engage in openings 23 in the holder 2. By providing the projection with flat portions 24 and suitably dimensioning the openings 23 the tilting range can be limited. FIG. 9*c* shows the tilt relative to FIG. 9*b*. These projections 22 are also shown in FIGS. 15 and 16. It is obvious that the tilting range can also be limited in another manner.

Figure 10:
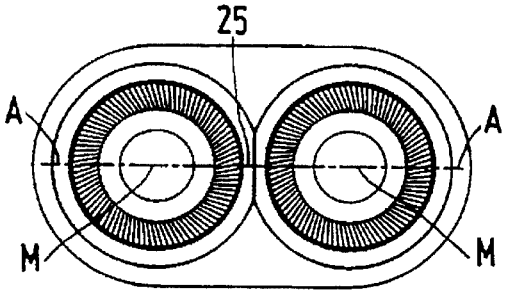
FIGS. 10–13 show different configurations of shaving heads with two, three and four cutting units, respectively.
Figure 11:
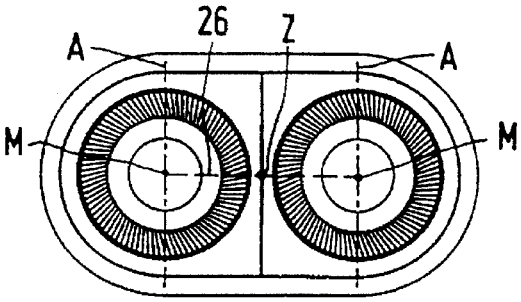
Figure 12:
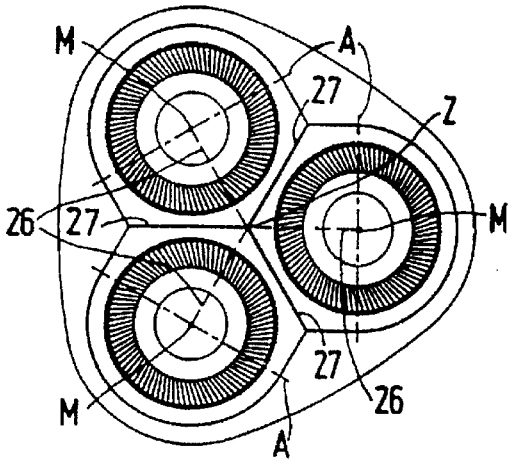
Figure 13:
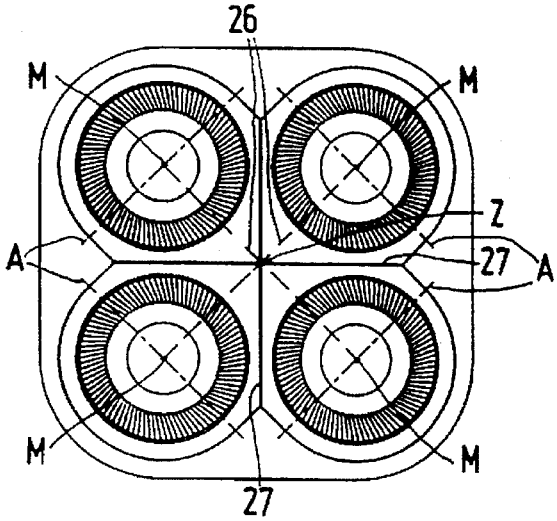

FIGS. 10–13 show different configurations of shaving heads with two, three or four cutting units. Each skin supporting rim with its associated cutting members is pivotable about an axis through the center of the cutting unit. The tilting axes are disposed in a plane parallel to the shaving surface 7 (see also FIG. 14). In FIG. 10 the tilting axes are parallel to the connecting line 25 through the centers M of the cutting units and are also in line with one another. In FIGS. 11–13 the tilting axes extend perpendicularly to a connecting line between the center of each cutting unit and the center Z of the combination of cutting units.

Figure 14:
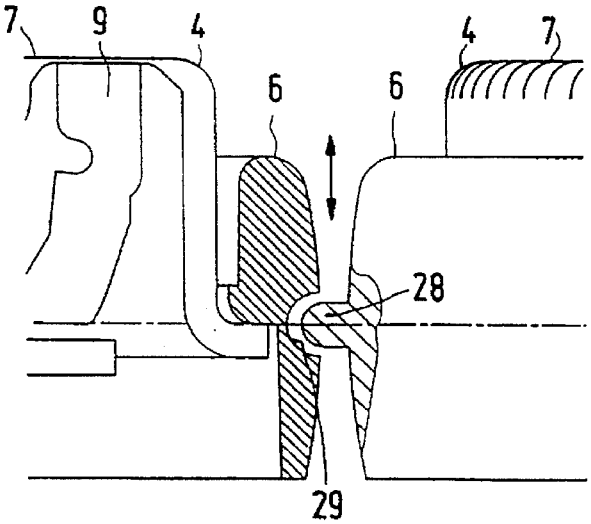
FIG. 14 shows a tongue-and-groove type hinge construction between two skin supporting rims.

The skin supporting rims of each shaving head can be pivotable independently of one another. However, they can also be coupled to one another by means of a hinge construction. FIG. 14 shows a construction in which the skin supporting rims are coupled by means of a so-called tongue-and-groove coupling. The skin supporting rims adjoin one another pairwise along portions which define a straight line 27 (see FIG. 12). Of these straight portions of each skin supporting rim one portion has a tongue 28 and the other portion has a groove 29. FIG. 15 is a perspective view showing such a skin supporting rim. Finally, FIG. 16 shows a construction for a triple-head shaving apparatus, where the three skin supporting rims are coupled to one another by means of an elastic integral hinge 30.

We claim:

1. A shaving apparatus having a housing, provided with a holder in which at least one cutting unit is mounted, which cutting unit comprises an external cutting member and an internal cutting member which is rotatably drivable relative to said external cutting member, and provided with a skin supporting rim surrounding the external cutting member, and means for effecting pivotable movement of said skin supporting rim, which external cutting member has at least one hair-entry aperture and is mounted so as to be movable relative to the holder, said internal cutting member being in resilient engagement with the external cutting member, wherein the skin supporting rim is pivotable both relative to its associated external cutting member and relative to the holder.

2. A shaving apparatus as claimed in claim 1, which it comprises two circular cutting units whose skin supporting rims are pivotable about a common axis which extends parallel to a connecting line through the centers of the cutting units.

3. A shaving apparatus as claimed in claim 1, which it comprises two or more circular cutting units each having a skin supporting rim which is pivotable about an axis situated in a plane parallel to a shaving plane defined by outer surfaces of the external cutting members, which axis extends perpendicularly to a connecting line between the center of each cutting unit and the center of gravity of the combination of cutting units.

4. A shaving apparatus having a housing, provided with a holder in which at least one cutting unit is mounted, which cutting unit comprises an external cutting member and an internal cutting member which is rotatably drivable relative to said external cutting member, and provided with a skin supporting rim surrounding the external cutting member, and means for affecting pivotable movement of said skin supporting rim, which external cutting member has at least one hair-entry aperture and is mounted so as to be movable relative to the holder, said internal cutting member being in resilient engagement with the external cutting member, wherein the skin supporting rim is pivotable both relative to its associated external cutting member and relative to the holder and is pivotable about two axes which are perpendicular to one another.

5. A shaving apparatus having a housing, provided with a holder in which two or more cutting units each having a skin supporting rim is mounted, which cutting units each comprise an external cutting member and an internal cutting member which is rotatably drivable relative to said external cutting member, and each provided with a skin supporting rim surrounding the external cutting member, and means for affecting pivotable movement of said skin supporting rims, which external cutting member has at least one hair-entry aperture and is mounted so as to be movable relative to the holder, said internal cutting member being in resilient engagement with the external cutting member, wherein each skin supporting rims is pivotable both relative to its associated external cutting member and relative to the holder and wherein the skin supporting rims are coupled to one another by means of a hinge construction.

6. A shaving apparatus as claimed in claim 5, wherein the hinge construction is a tongue-and-groove construction.

7. A shaving apparatus as claimed in claim 5, wherein the hinge construction is an elastic hinge which is integral with the skin supporting rims.

* * * * *